US008398498B2

(12) United States Patent
Qiu

(10) Patent No.: US 8,398,498 B2
(45) Date of Patent: Mar. 19, 2013

(54) SUSPENSION SWING DEVICE

(76) Inventor: Bingshun Qiu, Fujian Province (CN)

( * ) Notice: Subject to any disclaimer, the term of this patent is extended or adjusted under 35 U.S.C. 154(b) by 268 days.

(21) Appl. No.: 12/736,762

(22) PCT Filed: May 20, 2009

(86) PCT No.: PCT/CN2009/071865

§ 371 (c)(1),
(2), (4) Date: Nov. 5, 2010

(87) PCT Pub. No.: WO2009/140915

PCT Pub. Date: Nov. 26, 2009

(65) Prior Publication Data

US 2011/0059806 A1 Mar. 10, 2011

(30) Foreign Application Priority Data

May 23, 2008 (CN) ..... 2008 1 0071117

(51) Int. Cl.
*A63G 9/16* (2006.01)
*A63G 9/00* (2006.01)

(52) U.S. Cl. ..... 472/119; 472/125

(58) Field of Classification Search ..... 472/118–125; 297/273–277, 281; 5/109
See application file for complete search history.

(56) References Cited

U.S. PATENT DOCUMENTS 4,491,317 A * 1/1985 Bansal ..... 472/119
5,833,545 A * 11/1998 Pinch et al. ..... 472/119
6,254,490 B1 * 7/2001 Lawson et al. ..... 472/119
6,361,446 B2 * 3/2002 Lawson et al. ..... 472/119

* cited by examiner

*Primary Examiner* — Kien Nguyen
(74) *Attorney, Agent, or Firm* — Raymond Y. Chan; David and Raymond Patent Firm

(57) ABSTRACT

A suspension swing device includes a supporting beam (3) of a supporting bracket (1), a suspended joint (4) fixed on the supporting beam (3) via bearings, a suspended swing stems (41), a gear motor (5), a torque output plate (55), a swing pushing member (54), a swing direction monitor (6) and a microcomputer controller (7). The suspended swing stem (41) is mechanically connected with the suspended joint (4). The gear motor (5) is mechanically connected with the supporting beam (3). The torque output plate (55) and the swing pushing member (54) are connected to the output shaft of the gear motor (5). The microcomputer controller (7) is connected with the swing direction monitor (6) and the gear motor (5). The on-off operation of the gear motor (5) is controlled by the microcomputer controller (7).

9 Claims, 5 Drawing Sheets

SUSPENSION SWING DEVICE

BACKGROUND OF THE PRESENT INVENTION

1. Field of Invention

The present invention relates to a swing device, more particularly to a suspension swing electric device which can be used to swing, cradle, hammock, and other equipments which need automatic suspension swing device.

2. Description of Related Arts

Many China Patents teaching auto-swings and auto-cradles can be found in China Patent Literature Database. However, the corresponding products of auto-swings and auto-cradles cannot be found in the market. Accordingly, the auto-swings and auto-cradles have several drawbacks in order for mass production. For example, China Patent ZL97199159.6 disclosed an auto-swing device which has complicated structure and is limited to the swing device such that the auto-swing device cannot be used in different fields. Therefore, there is an improvement in the aspects of simple structure, reliability, energy saving, silent in operation, easy to carry, widely being applied in different fields.

SUMMARY OF THE PRESENT INVENTION

The invention solves the above problems that it provides a suspension swing device which is simple in structure, reliable, energy saving, silent in operation, easy to carry, and widely applied in different fields.

The present invention provides a suspension swing device which comprises a supporting bracket, a suspended swing stem, a gear motor, a torque output plate, a suspended swing stems, a swing direction monitor, and a microcomputer controller, etc.

The frame comprises a supporting bracket for supporting an object in a suspended position to swing in a reciprocating manner. There are at least two suspended joints fixedly connected to the supporting beam. Each of the suspended joints comprises a bearing seat and a bearing receiving therein.

The upper end of the suspended swing stem has a suspended swing shaft, wherein the suspended swing shaft is coupled with the bearings of the suspended joint. The lower end of the suspended swing stem is rigidly coupled to an upper end of the suspension frame. The connecting stem is extended between the two suspended swing stems together.

The gear motor is a decelerating motor with a gear and supported by the supporting beam via the motor bracket.

The torque output plate is rigidly coupled at the output shaft of the gear motor. The torque output plate, having an elongated structure, comprises two driving members, which are embodied as two rigid dowels, outwardly protruded from two ends of the torque output plate respectively.

The swing pushing member is operatively coupled with the output shaft of the gear motor and is positioned adjacent to the torque output plate, wherein two driving members of the torque output plate are engaged with two longitudinal edges of the swing pushing member respectively to transfer the torque of the gear motor to the swing pushing member.

The swing direction monitor comprises two parts. The first part comprises a control arm having a sleeve end coupling with a shaft sleeve of the swing pushing member where the output shaft is coupled, and a damping friction ring coaxially coupling between the sleeve end of the control arm and the shaft sleeve of the swing pushing member. The second part comprises a photoelectric switch operatively linked to the control arm, and a blocking frame selectively coupling with one of the gear motor and the gear motor bracket.

The microcomputer controller is controlled by the photoelectric switch of the swing direction monitor via a remote control, a keyboard, etc. The microcomputer controller also controls the gear motor in an on-and-off manner.

The present invention is advantageous in that the suspension swing device has simple structure, wherein the main components are only the gear motor and the microcomputer controller. The gear motor can directly drive the suspension frame to swing reciprocatingly through the torque output plate and the swing pushing member so as to enhance the reliability of the device without superfluous components. The swing of the suspension frame mainly relies on its inertia and the motor drive only occupies 5-20% of the swing cycle, to save electrical energy. No mechanical noise generated from the gear rotating and crankshaft connecting stem moving back and forth due to the impact thereof, so it can work silently. It has minimum components, small size, and light weight to be easily carried. It can be used in varieties of suspension swing drivers, such as swings, cradles, hammocks, so it can be widely used.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
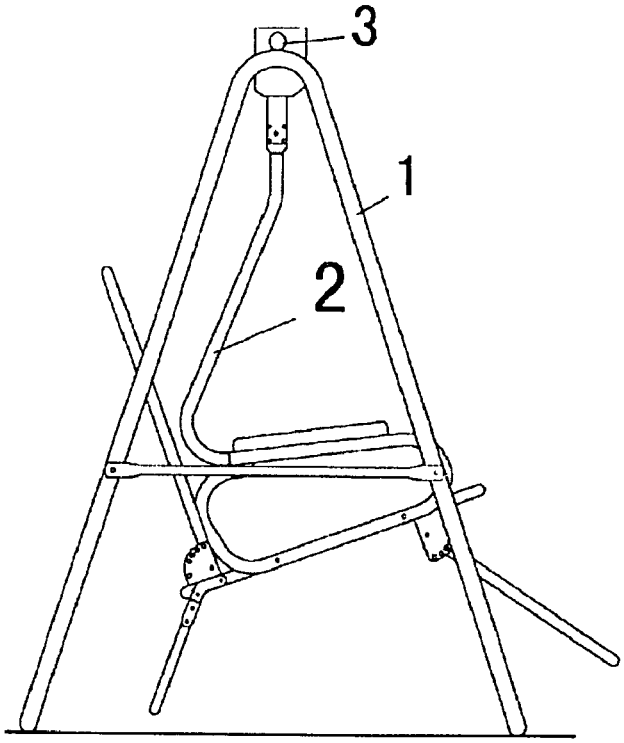
FIG. 1 is a schematic of a suspension swing device according to a first preferred embodiment of the present invention.
Figure 2:
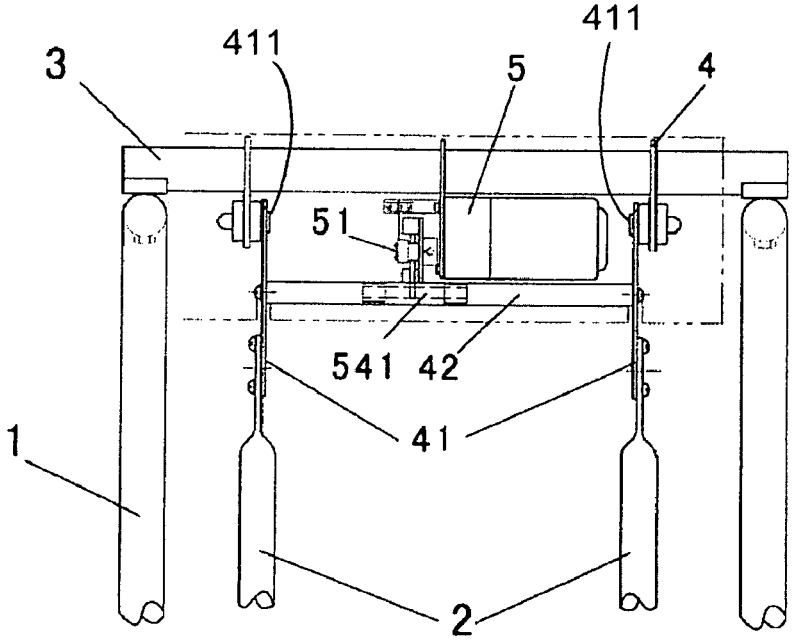
FIG. 2 is a front view of the suspension swing device according to the above first preferred embodiment of the present invention.
Figure 3:
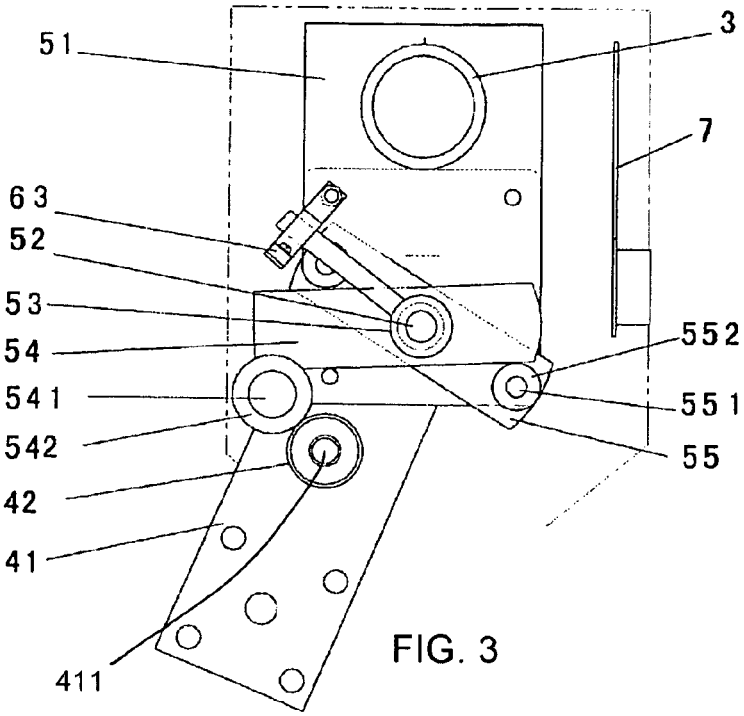
FIG. 3 is a left view of the suspension swing device according to the above first preferred embodiment of the present invention.
Figure 4:
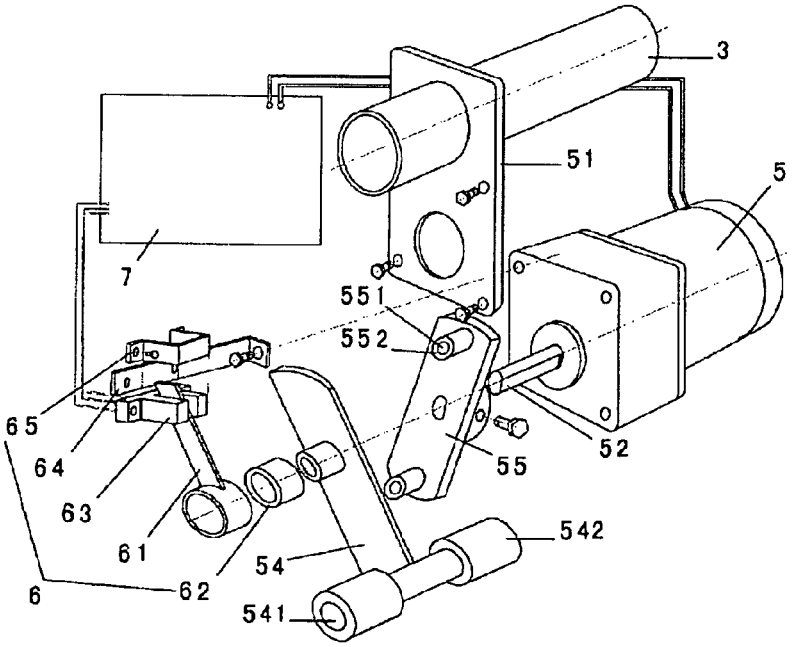
FIG. 4 is an exploded perspective view of the gear motor and the swing direction monitor of the suspension swing device according to the above first preferred embodiment of the present invention.
Figure 5:
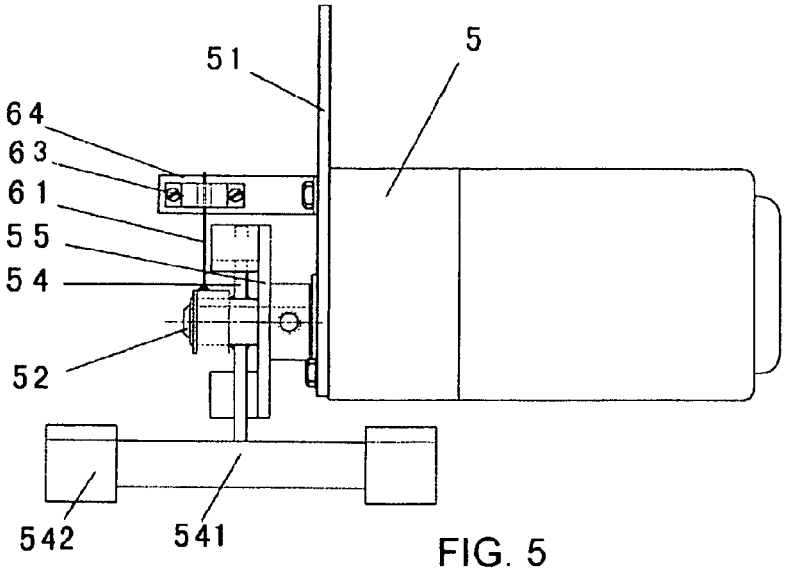
FIG. 5 is a front view of the gear motor and the swing direction monitor of the suspension swing device according to the above first preferred embodiment of the present invention.
Figure 6:
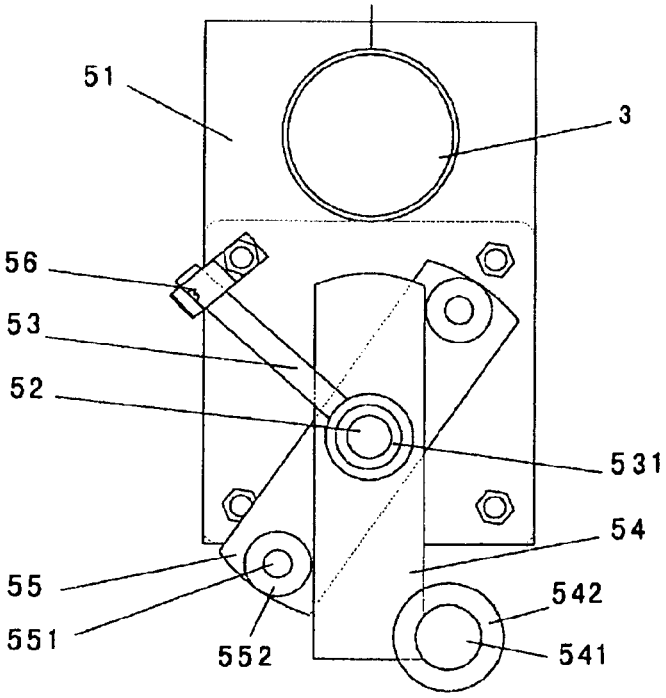
FIG. 6 is a left view of the gear motor and the swing direction monitor of the suspension swing device according to the above first preferred embodiment of the present invention.
Figure 7:
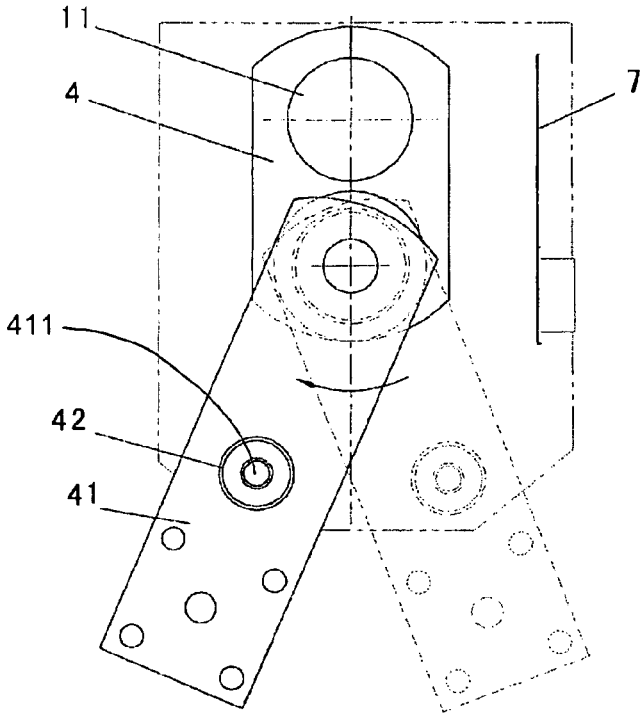
FIG. 7 is a schematic view illustrating the operation of the suspended swing stem of the suspension swing device according to the above first preferred embodiment of the present invention.

In order to further know the advantages and features of the suspension swing device of the invention, two embodiments with their drawings are described in detail. But the suspension swing device is not limited to the embodiments.

Referring to FIG. 1 to FIG. 7, and FIG. 10, a suspension swing device according to a first embodiment of the present invention is illustrated, wherein the suspension swing comprises a frame which comprises a supporting bracket 1, a suspension frame 2 for suspendedly supporting an object, a supporting beam 3, two suspended joints 4, a gear motor 5, a swing direction monitor 6, and a microcomputer controller 7. The supporting beam 3 is extended from the supporting bracket 1. The two suspended joint 4 are spacedly coupling at the supporting beam 3 for pivotally coupling with upper ends of the suspension frame 2. One end of a suspended swing stem 41 has a suspended swing shaft, wherein the suspended swing shaft is coupled with the bearings of the suspended joint 4. An opposed end of the suspended swing stem 41 is rigidly hinged to the upper end of the suspension frame 2. A connecting stem 42 is transversely extended between the two suspended swing stems 41. In other words, two ends of the connecting stem 42 are coupled with the suspended swing stems 41 together for enhancing the supporting configuration the suspended swing stem 41. A gear motor bracket 51 is coupled at the supporting beam 3 to support the gear motor 5 such that the gear motor 5 is coupled at and supported by the supporting beam 3 via the gear motor bracket 51. The gear motor 5 comprises an output shaft 52 operatively coupled with a torque output plate 55 to drive the torque output plate 55 in a swing reciprocating manner. The torque output plate 55, having an elongated structure, comprises two driving members 551, which are embodied as two rigid dowels, outwardly protruded from two ends of the torque output plate 55 respectively, wherein the output shaft 52 is coupled at the torque output plate 55 at a position between the two driving members 551. An elongated swing pushing member 54 is operatively coupled with the output shaft 52 of the gear motor 5 and is positioned adjacent to the torque output plate 55, wherein the swing pushing member 54 has a shaft sleeve to operatively couple with the output shaft 52 of the gear motor 5. The two driving members 551 of the torque output plate 55 are engaged with two longitudinal edges of the swing pushing member 54 respectively at a position that one of the driving members 551 is located at the corresponding longitudinal edge of the swing pushing member 54 at an upper portion thereof while another driving members 551 is located at the opposed longitudinal edge of the swing pushing member 54 at a lower portion thereof. In particular, the driving members 551 are contacted with the longitudinal edges of the swing pushing member 54 in such a manner that when the gear motor 5 generates a rotational power at the output shaft 52 to drive the torque output plate 55 in a swing reciprocating manner, the swing pushing member 54 is pushed and driven to move in a swing reciprocating manner. In other words, the rotation power from the gear motor 5 is transferred to the swing pushing member 54. The swing pushing member 54 comprises an elongated swing pusher 541 transversely extended from a lower end of the swing pushing member 54, wherein the swing pusher 541 is contacted with the connecting stem 42 to drive the suspended swing stems 41 and the suspension frame 2 to swing in a reciprocating manner. In other words, when the swing pushing member 54 is driven to swing in a reciprocating manner, the connecting stem 42 is pushed by the swing pusher 541 so as to drive the suspension frame 2 to swing in a reciprocating manner. The swing direction monitor 6, which is arranged for determining a swing direction of the suspension frame 2, comprises a control arm 61 having a sleeve end coupled with the shaft sleeve of the swing pushing member 54 at a position where the output shaft 52 is coupled. The swing direction monitor 6 further comprises a damping friction ring 62 coaxially coupled within the sleeve end of the control arm 61 and is coupled with the shaft sleeve of the swing pushing member 54. In other words, the damping friction ring 62 is coaxially coupled between the sleeve end of the control arm 61 and the shaft sleeve of the swing pushing member 54. The swing direction monitor 6 further comprises a photoelectric switch 63, and a photoelectric switch bracket 64 supporting the photoelectric switch 63 thereat, and a blocking frame 65 supported by the photoelectric switch bracket 64 at a position above the photoelectric switch 63, wherein the photoelectric switch bracket 64 is coupled at either the gear motor 5 or the gear motor bracket 51 to retain the photoelectric switch bracket 64 in position. An opposed free end of the control arm 61 is operatively linked to the photoelectric switch 63 such that the photoelectric switch 63 is controlled by the movement of the control arm 61. A signal line of the photoelectric switch 63 is electrically linked to the microcomputer controller 7 which is electrically linked to the gear motor 5.

Figure 8:
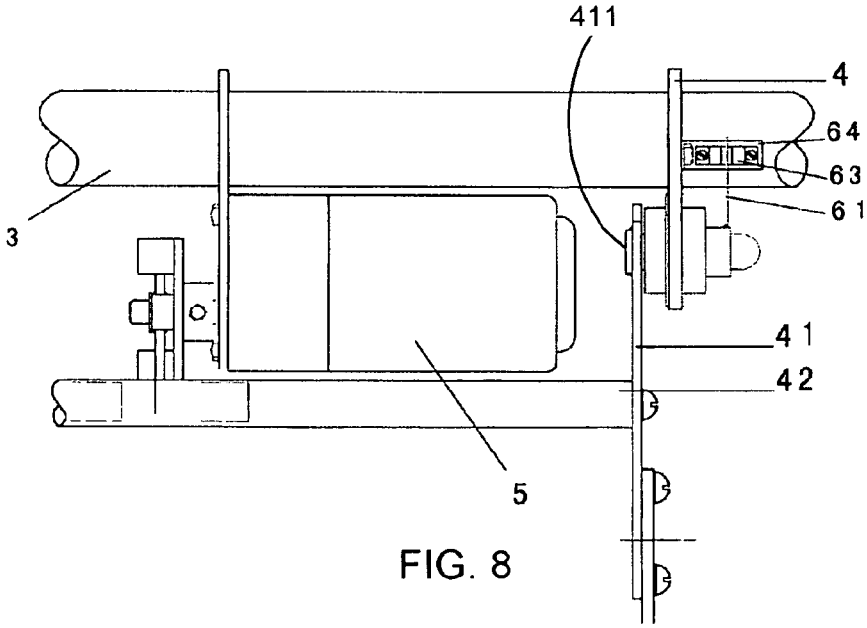
FIG. 8 is a front view of the swing direction monitor of the suspension swing device according to a second embodiment of the present invention.
Figure 9:
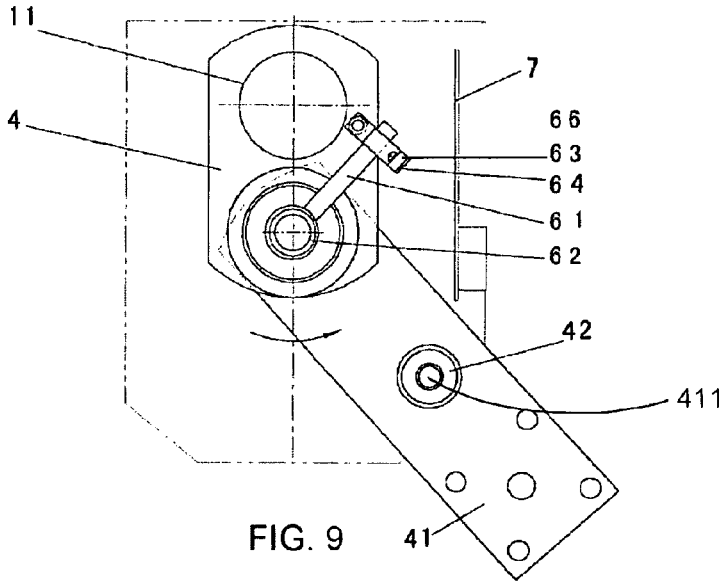
FIG. 9 is a right view of the swing direction monitor of the suspension swing device according to the second preferred embodiment of the present invention.
Figure 10:
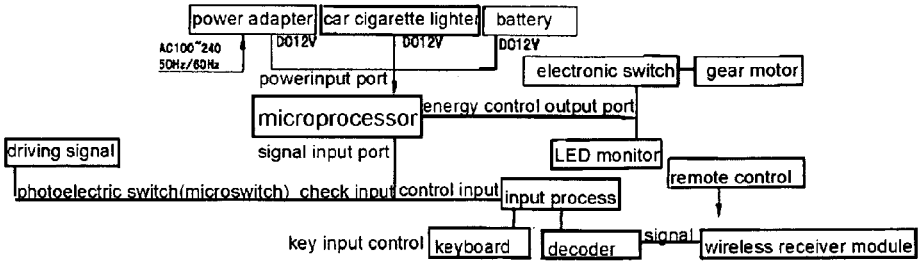
FIG. 10 is a block diagram of the microcomputer controller according to the first and second embodiments of the present invention.

As shown in FIG. 8 to FIG. 10, a suspension swing device according to a second embodiment of the present invention illustrates an alternative mode of the first embodiment, wherein the structural configuration of the second embodiment is the same as that of the first embodiment, except the location of the swing direction monitor 6. Accordingly, the sleeve end of the control arm 61 of the swing direction monitor 6 is coupled at the suspended swing shaft of one of the suspended swing stems 41, wherein the damping friction ring 62 is coaxially coupled between the sleeve end of the control arm 61 and the suspended swing shaft of the suspended swing stem 41. The photoelectric switch 63 is supported by the photoelectric switch bracket 64, wherein the blocking frame 65 supported by the photoelectric switch bracket 64 at a position above the photoelectric switch 63. The photoelectric switch bracket 64 is coupled at either the suspension frame 2 or the supporting beam 3 to retain the photoelectric switch bracket 64 in position. The opposed free end of the control arm 61 is operatively linked to the photoelectric switch 63 such that the photoelectric switch 63 is controlled by the movement of the control arm 61. The signal line of the photoelectric switch 63 is electrically linked to the microcomputer controller 7 which is electrically linked to the gear motor 5.

The operation of the suspension swing device according to the first embodiment of the present invention is that when the suspension swing device is electrically connected to a power source, the suspension frame 2 can be initially started to be pushed at a forward direction for swinging in a reciprocating motion preferably by applying an initially manual pushing force. When the suspension frame 2 is started swinging, the suspended swing stems 41 are driven to swing correspondingly. In other words, the connecting stem 42 is driven to move corresponding to the swinging motion of the suspended swing stems 41, such that the swing pushing member 54 is pushed by the reciprocating movement of the connection stem 42 via the swing pusher 541 at a forward direction. At the mean time, the control arm 61 is driven to rotate through the damping friction ring 62 at a forward direction in responsive to the rotational movement of the shaft sleeve of the swing pushing member 54 when the swing pushing member 54 is moved. When the control arm 61 is free to move, i.e. the free end thereof is not blocked by the blocking frame 65, the damping friction ring 62 and the sleeve end of the control arm 61 are synchronously rotated with respect to the rotational movement of the shaft sleeve of the swing pushing member 54. When the free end of the control arm 61 is blocked by the bottom side of the photoelectric switch 63 or the blocking frame 65, the damping friction ring 62 and the sleeve end of the control arm 61 are stopped being rotated in responsive to the rotational movement of the shaft sleeve of the swing pushing member 54. In other words, the damping friction ring 62 and the sleeve end of the control arm 61 are skidded turn when the shaft sleeve of the swing pushing member 54 is rotated. Accordingly, the control arm 61 is extended at the mid-portions of the photoelectric switch 63 and the blocking frame 65. The rotational movement of the shaft sleeve of the swing pushing member 54 will drive the control arm 61 to move a clearance between two operating components of the photoelectric switch 63 and to move between the photoelectric switch 63 and the blocking frame 65. Therefore, the photoelectric switch 63 will be actuated to switch on and off in responsive to the movement of the control arm 61. Accordingly, the photoelectric switch 63 will output a high electric level signal or a low electric level signal to the microcomputer controller 7. The microcomputer controller 7 is electrically linked to the power source of the gear motor 5 to control the operation of the gear motor 5. When the gear motor 5 is actuated to generate the rotational power at the output shaft 52 to drive the torque output plate 55 to move, the swing pushing member 54 is pushed and driven to move correspondingly. Therefore, when the swing pushing member 54 is driven to swing in a reciprocating manner, the connecting stem 42 is pushed by the swing pusher 541 so as to drive the suspended swing stems 41 and the suspension frame 2 to swing in a reciprocating manner. The actuation time of the gear motor 5 is controlled by a microprocessor of the microcomputer controller 7 according to the signals inputted through an input unit, such as keyboard or a remote control, with the preloaded program. When the actuation time of the gear motor 5 is set with longer time period, the amplitude of the swinging movement of the suspension frame 2 will be increased. Accordingly, the driving power of the gear motor 5 is unidirectional. Therefore, when the gear motor 5 is stopped generating the rotational power, the connecting stem 42 will keep swinging and will move apart from the swing pushing member 54 because of the inertia of the suspension frame 2. When the suspension frame 2 is swung at the highest position, i.e. the forward inertia of the suspension frame 2 is lost, the suspension frame 2 will be swung back automatically. Therefore, the suspended swing stem 41 is driven to swing backwardly to drive the connecting stem 42 contacting with the swing pushing member 54. In other words, the damping friction ring 62 and the sleeve end of the control arm 61 will be driven to rotate together at the opposite direction with respect to the rotational movement of the shaft sleeve of the swing pushing member 54. Therefore, the control arm 61 will be returned back to its original position for next cycle.

The operation of the suspension swing device according to the first embodiment of the present invention is that when the suspension swing device is electrically connected to a power source, the suspension frame 2 can be initially started to be pushed at a forward direction for swinging in a reciprocating motion preferably by applying an initially manual pushing force. When the suspension frame 2 is started swinging, the suspended swing stems 41 are driven to swing correspondingly. In other words, the connecting stem 42 is driven to move corresponding to the swinging motion of the suspended swing stems 41. At the mean time, the control arm 61 is driven to rotate through the damping friction ring 62 at a forward direction in responsive to the rotational movement of the suspended swing shaft of the suspended swing stem 41 when the suspended swing stems 41 is moved. When the control arm 61 is free to move, i.e. the free end thereof is not blocked by the blocking frame 65, the damping friction ring 62 and the sleeve end of the control arm 61 are synchronously rotated with respect to the rotational movement of the suspended swing shaft of the suspended swing stem 41. When the free end of the control arm 61 is blocked by the bottom side of the photoelectric switch 63 or the blocking frame 65, the damping friction ring 62 and the sleeve end of the control arm 61 are stopped being rotated in responsive to the rotational movement of the suspended swing shaft of the suspended swing stem 41. In other words, the damping friction ring 62 and the sleeve end of the control arm 61 are skidded turn when the suspended swing shaft of the suspended swing stem 41 is rotated. Accordingly, the control arm 61 is extended at the mid-portions of the photoelectric switch 63 and the blocking frame 65. The rotational movement of the suspended swing shaft of the suspended swing stem 41 will drive the control arm 61 to move a clearance between two operating components of the photoelectric switch 63 and to move between the photoelectric switch 63 and the blocking frame 65. Therefore, the photoelectric switch 63 will be actuated to switch on and off in responsive to the movement of the control arm 61. Accordingly, the photoelectric switch 63 will output a high electric level signal or a low electric level signal to the microcomputer controller 7. The microcomputer controller 7 is electrically linked to the power source of the gear motor 5 to control the operation of the gear motor 5.

The swing pusher 541 at the lower end of the swing pushing member 54 is naturally dropped down without any external force. It is appreciated that a spring can be coupled at the swing pushing member 54 for applying a spring force thereat to naturally drop down the swing pusher 541 without any external force.

According to the program design of the microprocessor, the high electric level or low electrical level signals outputted from the photoelectric switch 63 can be response signals. The photoelectric switch 63 may be a magnetic control switch, a micro switch, or other control components.

Buffering elements 552 and 542 (such as springs or rubber) may be positioned at the two driving members 551 of the torque output plate 55 and the swing pusher 541 of the swing pushing member 54 to reduce the impact of the gear motor torque against the swing pushing member 54 and the noises.

The present invention is not limited to the above detailed description and the embodiments. People who skilled in the related art can easily produce the alternative embodiments or improvements based on the above detailed description. So, all of the alternative embodiments and improvements are in the scope of the claims of the present invention.

INDUSTRIAL APPLICABILITY

The main components of the present invention are the gear motor 5 and the microcomputer controller 7 which provides reliability services without superfluous components. The gear motor 5 can directly drive the suspension frame 2 to swing through the torque output plate 55 and the swing pushing member 54 which is saving energy, few components, small, light, wide use, and good industrial applicability.

One skilled in the art will understand that the embodiment of the present invention as shown in the drawings and described above is exemplary only and not intended to be limited.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A suspension swing device, comprising a frame comprising a supporting bracket, a suspension frame for suspendedly supporting an object, a supporting beam extending from said supporting bracket, and two suspended joints spacedly coupling at said supporting beam for pivotally coupling with said suspension frame; two suspended swing stems pivotally coupling with said suspended joints respectively and rigidly coupling with two upper ends of said suspension frame respectively, wherein each of said suspended swing stems has a suspended swing shaft coupled with bearings of said suspended joint; a gear motor supported by said supporting beam, wherein an output shaft of said gear motor is operatively coupled with a torque output plate and a swing pushing member; a swing direction monitor for determining a swing direction of said suspension frame; and a microcomputer controller electrically linked to said swing direction monitor and said gear motor for controlling said gear motor in an on-and-off manner in responsive to said swing direction monitor.

2. The suspension swing device, as recited in claim 1, wherein said suspended swing shaft is provided at one end of said suspended swing stem to couple with said bearings of said suspension joint while an opposed end of said suspended swing stem is rigidly coupled with said corresponding upper end of said suspension frame, wherein a connecting stem is extended between said suspended swing stems.

3. The suspension swing device, as recited in claim 2, wherein said swing direction monitor is selectively coupled with one of a shaft sleeve of the swing pushing member and one of said suspended joints.

4. The suspension swing device, as recited in claim 1, further comprising a gear motor bracket coupled at said supporting beam, wherein said gear motor is supported by said gear motor bracket.

5. The suspension swing device, as in recited claim 4, wherein said torque output plate, having an elongated structure, comprises two driving members outwardly protruded from two ends of said torque output plate respectively, wherein said output shaft of said gear motor is coupled at said torque output plate at a position between said two driving members.

6. The suspension swing device, as recited in claim 4, wherein said swing pushing member is operatively coupled with said output shaft of said gear motor and is positioned adjacent to said torque output plate, wherein two driving members of said torque output plate are engaged with two longitudinal edges of said swing pushing member respectively.

7. The suspension swing device, as recited in claim 6, wherein said swing direction monitor comprises a control arm having a sleeve end coupling with a shaft sleeve of said swing pushing member where said output shaft is coupled, a damping friction ring coaxially coupling between said sleeve end of said control arm and said shaft sleeve of said swing pushing member, a photoelectric switch operatively linked to said control arm, and a blocking frame selectively coupling with one of said gear motor and said gear motor bracket.

8. The suspension swing device, as recited in claim 1, wherein said microcomputer controller is controlled by said photoelectric switch of said swing direction monitor via one of a remote control and a keyboard, to control said gear motor in an on-and-off manner.

9. The suspension swing device, as recited in claim 8, wherein said photoelectric switch of said swing direction monitor is selected from the group consisting of a magnetic control switch, a micro switch, and a sensor switch.

* * * * *